US005538402A

United States Patent [19]

McKenney

[11] Patent Number: 5,538,402

[45] Date of Patent: Jul. 23, 1996

[54] MODULAR SPRAYING APPARATUS

[76] Inventor: Joseph E. McKenney, 134 Tam-O-Shanter, Blythewood, S.C. 29016

[21] Appl. No.: 299,066

[22] Filed: Aug. 31, 1994

[51] Int. Cl.[6] ..... F04B 21/00

[52] U.S. Cl. ..... 417/234; 417/360; 417/362

[58] Field of Search ..... 417/234, 359, 417/360, 362

[56] References Cited

U.S. PATENT DOCUMENTS

| | | | |
|---|---|---|---|
| 2,367,601 | 1/1945 | Nicol | 417/362 |
| 2,454,339 | 11/1948 | Potts et al. . | |
| 2,708,596 | 5/1955 | Weller . | |
| 2,719,754 | 10/1955 | Weller . | |
| 2,749,997 | 6/1956 | Deslippe . | |
| 3,680,786 | 8/1972 | Levy . | |
| 3,797,743 | 3/1974 | Kommers et al. . | |
| 3,831,849 | 9/1974 | Studinger . | |
| 4,655,693 | 4/1987 | Grime | 417/362 |
| 4,865,255 | 9/1989 | Luvisotto . | |
| 5,154,251 | 10/1992 | Fought . | |
| 5,378,119 | 1/1995 | Goertzen | 417/362 |
| 5,382,138 | 1/1995 | Chilton | 417/234 |

FOREIGN PATENT DOCUMENTS

| | | | |
|---|---|---|---|
| 7537874 | 7/1977 | France | 417/234 |

*Primary Examiner*—Charles Freay
*Attorney, Agent, or Firm*—Michael A. Mann

[57] ABSTRACT

A mobile, modular apparatus for power spraying comprises a first adapter attached to a motor and a second adapter attached to a pump. Both adapters are received and positioned on a wheeled frame with the driving sheave of the motor in operational alignment with the driven sheave of the pump. A recess in the pump adaptor receives a locking bar on the frame to partially lock the pump adaptor in place; the positioning of the motor adaptor on the frame completes the locking of the pump adaptor in place. Before the motor adaptor is locked into position, one or more drive belts are installed on the driving and driven sheaves by rotating the motor about the pump adaptor far enough to where the belts will fit loosely onto the sheaves. The belts are made operationally tight when the motor is rotated back into position on the frame. The motor adaptor is locked into place with a swing lock. The sheaves are covered by a housing that is latched into place. The modular construction makes the apparatus easier to lift, transport, and customize for different uses.

20 Claims, 3 Drawing Sheets

MODULAR SPRAYING APPARATUS

BACKGROUND OF THE INVENTION

1. Field of the Invention

The present invention relates generally to mobile power sprayers such as power washers and paint sprayers. In particular, the present invention relates to a mobile power sprayer wherein the components are modular; that is, they are adapted to be easily assembled onto and disassembled from a wheeled frame without the need for tools.

2. Discussion of Background

Power washers, for example, are often used to wash large items such as houses to remove mold and mildew. Power washers are usually rented for the duration of use and then transported to and from the location of use. Weighing well over 100 pounds, a power washer can be lifted by two adults onto the back of a pickup truck. However, it is much too heavy and awkward for a single adult to lift onto or off of a truck or from the trunk of a car. These washers are also too large for transporting in car trunks.

Mobile power sprayers are known in the art. For example, U.S. Pat. No. 3,797,743 presents an insecticide/herbicide sprayer with a gasoline engine. The sprayer is composed of individual components that are bolted to each other and also to a movable cart.

U.S. Pat. No. 4,865,255 teaches a sprayer for herbicides and insecticides wherein a bi-level cart is formed to receive a reservoir, a battery and an electric pump. The upper level of the cart holds a removable reservoir, while the lower level houses a dedicated battery and pump.

U.S. Pat. No. 3,831,849 teaches a spray washer where all the components are mounted on a skid. The skid can be placed on a trailer by a fork lift and can be transported as a complete unit.

U.S. Pat. No. 3,680,786 teaches a spraying apparatus that provides for the easy removal of the reservoirs of cleaning solution. However, the remainder of the components, i.e. the pump and the motor, are dedicated to the unit. Similarly, U.S. Pat. No. 2,719,754 teaches a portable sprayer that has a reservoir that is removable from a wheeled hand truck. The truck also carries a mounted gasoline engine and a pump with flow control valve.

One problem associated with many current modular designs is the method of fastening the components to the cart or skid. The majority of these designs employ bolts, screws, wing nuts or the like to fasten the components. These methods are time-consuming, increase the difficulty of assembly, require tools, and create the possibility of injury.

Because present power spray washers are not modularized, there is a lack of flexibility in meeting specific washing needs. Specifically, because the pump and motor are dedicated to the unit, it is impossible to select individual components that meet the requirements of a particular application. More importantly, the motor used in a power washer could power a paint sprayer but is dedicated to the power washer. Therefore, two separate units are used when a house painter, for example, wants to first wash a house with a power washer in preparation for painting and then paint the house with a paint sprayer.

Therefore, them is a need for a power spraying apparatus that can be transported in individual, light-weight components, is easy to assemble, and provides flexibility in enabling the user to tailor the apparatus for a particular task.

SUMMARY OF THE INVENTION

According to its major aspects and briefly stated, the present invention is a mobile, modular spraying apparatus comprising a frame, a motor having a driving sheave, a pump having a driven sheave, a belt which translates the rotational motion of the driving sheave to the driven sheave, a first adapter attached to the motor, a second adapter attached to the pump, and a housing which covers the belt and sheaves. The frame is dimensioned to receive both adapters in such a way that the operational alignment between the driving sheave and the driven sheave is maintained. The frame is fitted with wheels, and the housing contains a handle, thereby allowing a user to move the assembled apparatus easily. The first and second adapters and the housing locked or latched to the frame. With the appropriate motor and pump attached, the apparatus can be used to spray air, steam, water, detergents, paints, herbicides, pesticides and particulate matter such as sand.

The use of adapters to position and maintain the pump and motor on the frame in correct operational alignment is an important feature of the present invention. In the present power washer, the bases of the pump and motor are attached directly to the frame, usually by bolting. Here, the bases are attached to the adaptors and the adaptors are simply placed onto the frame and locked into place. Because the motor and the pump are individually and easily removed from the frame, the user need only lift one component at a time and can arrange them in a car trunk as he wishes. This feature makes it easier for one adult to transport a power washer without injury, especially back injuries and without the need for a truck. Furthermore, a user can assemble and de-assemble the apparatus simply, quickly and without assistance or tools. Moreover, modularization enables the user to select the components he needs knowing that the adaptors attached to them will effect the correct alignment of driving and driven sheaves.

The locking features of the frame and adapters is another important feature of the present invention. The frame has a locking bar to help secure the pump and a swing lock to secure the motor. The adjacent relation of the adaptors in combination with the frame, also secures the pump and motor to the frame. The user simply positions the pump adaptor in the frame with the locking bar in a cutout portion in the pump adaptor, followed by positioning the motor adaptor, and then swings the swing lock into position. Therefore, although no tools are needed, the pump and motor are securely locked to the frame for use and in correct operational alignment.

Still another feature of the present invention related to the cooperation of the adaptors and the frame is the way the belt is applied to the driving and driven sheaves. By rotating the motor about the end of the pump adaptor, the driving sheave is moved closer to the driven sheave so that the belt can be put around them both easily. Then, when the motor is rotated back into position on the frame, the correct separation of the driving and driven sheaves is obtained to tighten the belt for operation.

Still yet another feature of the present invention is the housing which covers both the sheaves and the belt. The housing includes a handle that lies in the same plane as the housing itself so it will lie flat in a trunk.

Other features and advantages of the present invention will be apparent to those skilled in the art from a careful reading of the Detailed Description of A Preferred Embodiment accompanied by the following drawings.

DETAILED DESCRIPTION OF A PREFERRED EMBODIMENT

Figure 1:
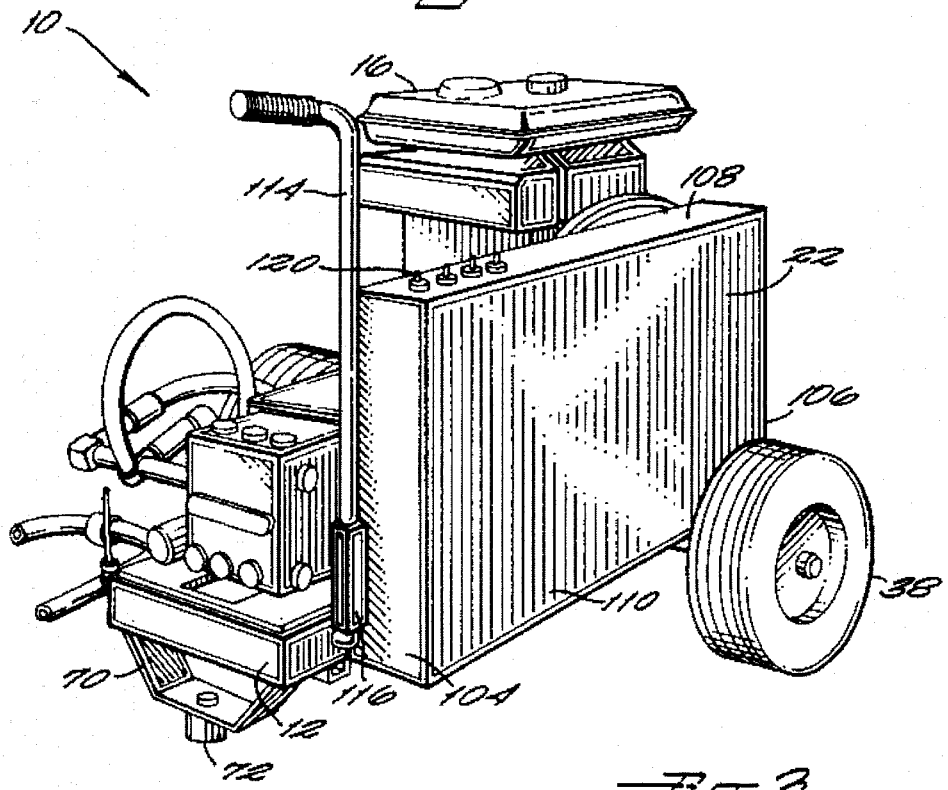
FIG. 1 is a perspective view of the power sprayer according to a preferred embodiment of the present invention.
Figure 3:
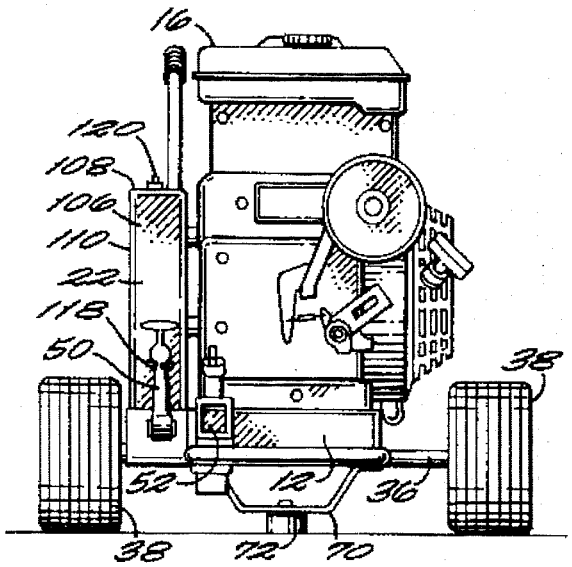
FIG. 3 is a back view of the power sprayer according to a preferred embodiment of the present invention.
Figure 2:
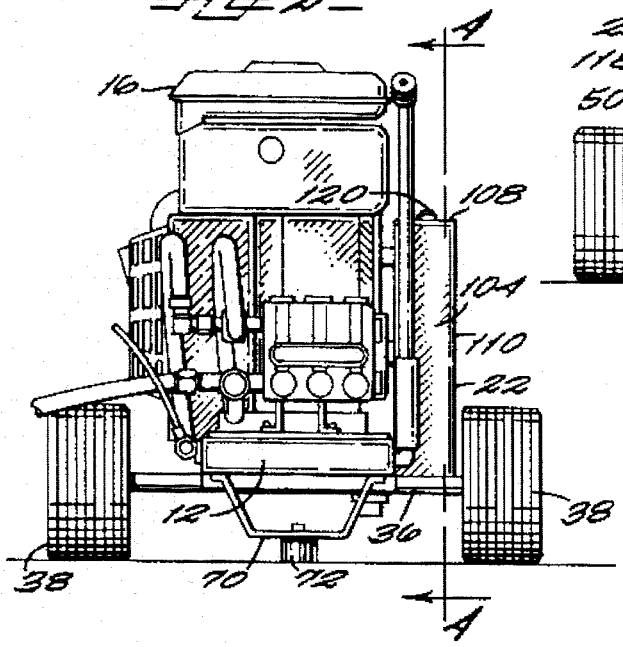
FIG. 2 is a frontal view of the power sprayer according to a preferred embodiment of the present invention.
Figure 4:
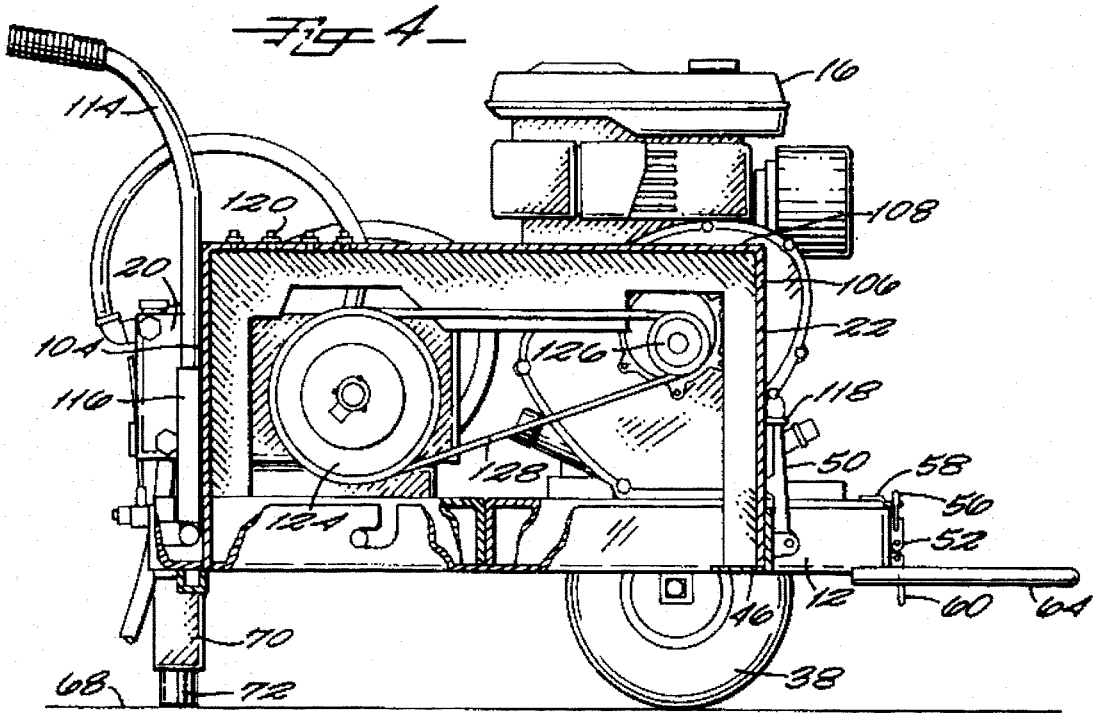
FIG. 4 is a partial, cross-sectional side view of taken along line 4—4 of FIG. 2.

The present invention is a modular, mobile apparatus for power spraying water, paints, herbicides, pesticides and particulate matter such as sand. "Modular" means that the major components—here, the motor, the pump, the belt housing and the frame—are easily separable from each other, in the following embodiment without tools, and interchangeable with other equivalent components. The purposes of making the present invention modular are as follows: (1) to make the apparatus much easier to lift, one component at a time; (2) to enable the apparatus, as separated components, fit into the trunk of a car; and (3) to enable selection of components for different requirements and uses.

Referring now to FIG. 1–6, the apparatus, generally indicated by the reference numeral 10, has a frame 12, a first, or "motor," adapter 14, a motor 16, a second, or "pump," adapter 18, a pump 20, and a housing 22. Motor 16 can be a gasoline engine, an electric motor, or any other type of power source that produces rotational motion in a sheave. Pump 20 may be a water pump, a paint pump, a vacuum pump, or any other type of pump having a driven sheave.

Figure 5:
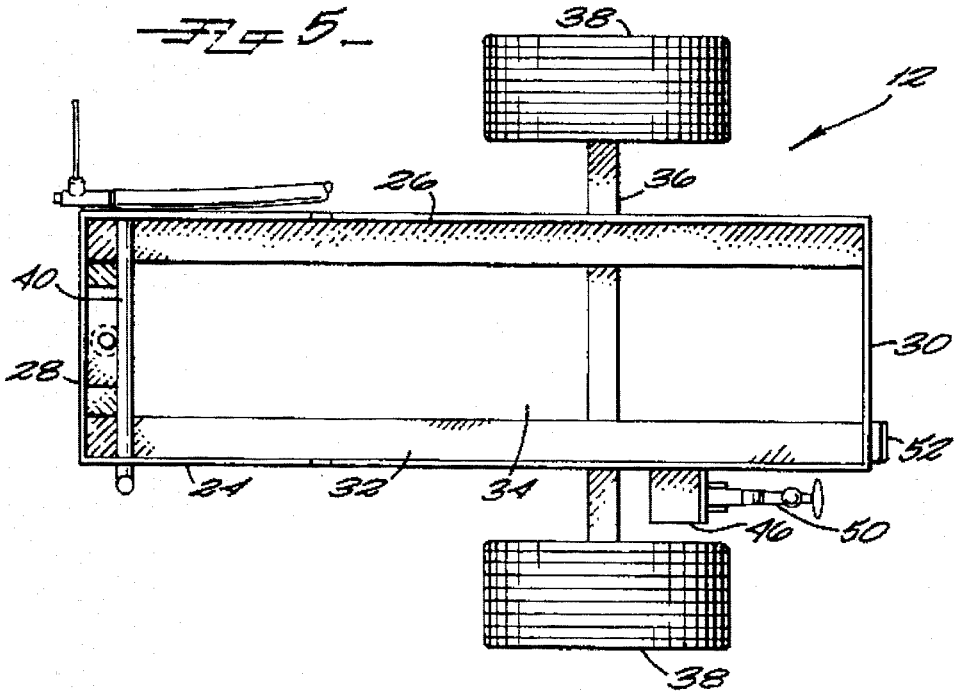
FIG. 5 is a top view of the frame of a preferred embodiment of the present invention.

Frame 12, most easily seen in FIG. 5, has a first side 24, a second side 26, a first end 28, a second end 30 and a bottom 32. As shown, bottom 32 has an opening 34. It should be appreciated that opening 34 is optional and could be replaced by a solid bottom. Frame 12 can be made of angled steel members welded together or other sufficiently rigid alloy, plastic or ceramic.

Journaled in frame 12 is a horizontal axle 36 with wheels 38 placed at each of its ends. Proximate to first end 28 is a bar 40. Bar 40 runs perpendicular to sides 24 and 26 and extends vertically upward after passing through side 24 to serve as a post for the handle of housing, which will be described in detail presently. Notches 42 are formed in sides 24 and 26.

Extending from first side 24 is a housing support 46. Attached to housing support 46 is a housing latch 50. Second end 30 has a swing lock 52 extending therefrom. A "swing lock" is a three part latch, well known to those of ordinary skill and of the type commonly found on trucks and cases, that has a rectangular loop 56 (FIG. 4) that is seated in a curved flange 58 on motor adaptor 16 and then pulled snug by rotation of a handle 60 in the direction shown. Releasing swing lock 52 is achieved by lifting handle 60 to disengage loop 56 from flange 58.

Frame 12 is also equipped with a stabilization bar 64. Stabilization bar 64 (shown in FIG. 4 and 6) extends horizontally from sides 24 and 26 and beyond second end 30. When apparatus 10 is in motion, stabilization bar 64 prevents second end 30 from contacting surface 68 due to the concentration of weight placed near second end 30. Depending from bottom 32 is a member 70 having a stopper 72. When apparatus 10 is at rest, the combination of member 70, stopper 72 and wheels 38 keeps apparatus 10 level.

Figure 6:
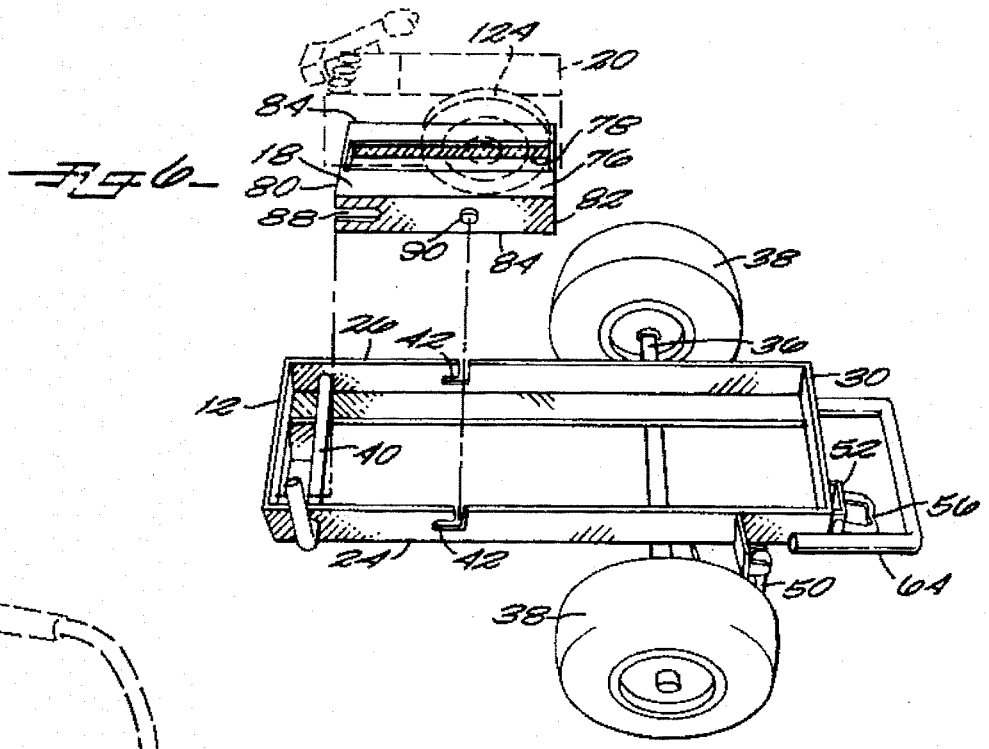
FIG. 6 is a perspective view of the frame and pump adapter according to a preferred embodiment of the present invention with the pump shown in phantom.

Referring to FIG. 6, there is shown a pump 20 (in phantom) secured to pump adapter 18. Pump adapter 18 contains a top 76 having an opening 78, a first end 80 and a second end 82. Pump 20 is secured to pump adapter 18 by bolting the bottom of pump 20 onto top 76. Pump adapter 18 also contains sides 84 depending from top 76. Sides 84 have cutout portions 88 formed at first end 80 and fingers 90 deployed along their lengths. Cutout portions 88 receive bar 40 when pump adaptor 18 is positioned in frame 12; and fingers 90 slide down and forward in notches 42 as pump adaptor 18 is moved into position.

Figure 7:
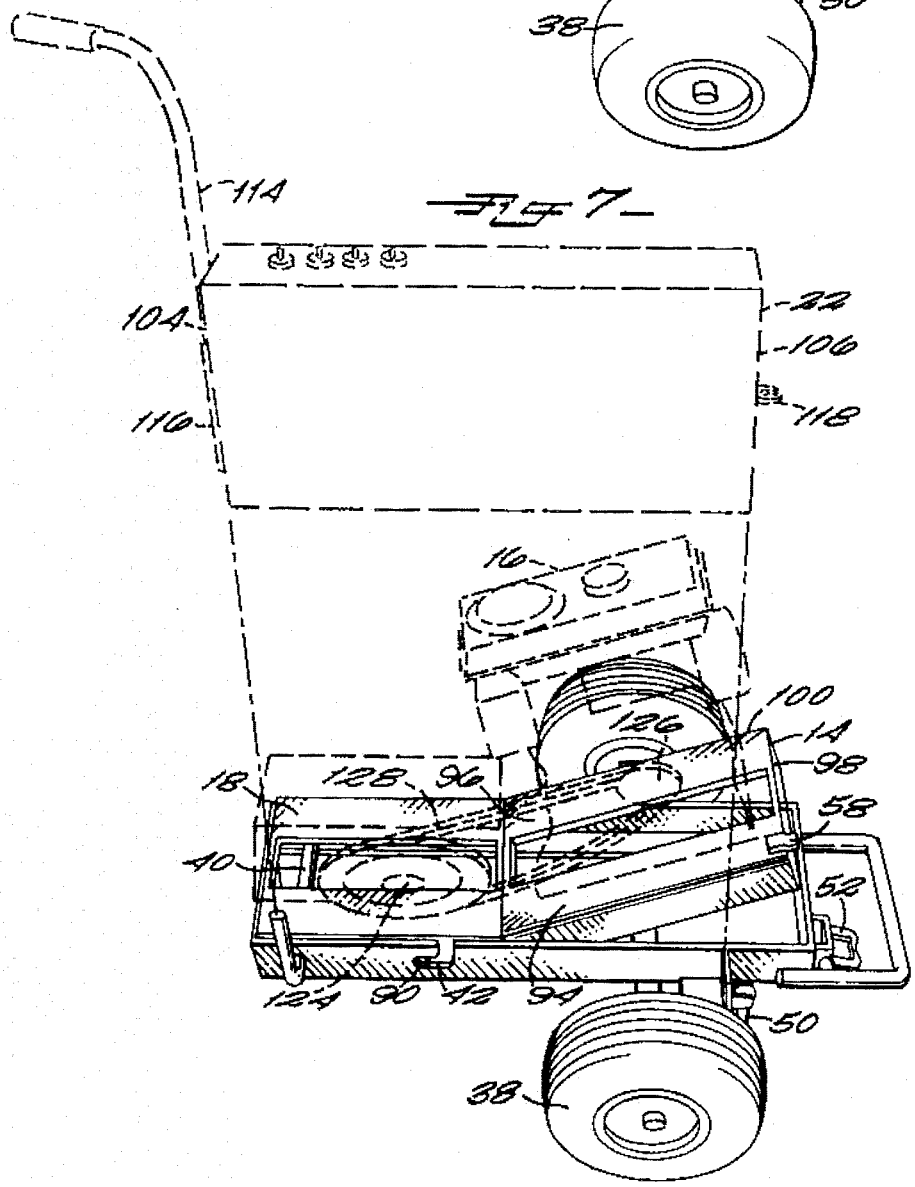
FIG. 7 is another perspective view of the present invention showing the first and second adaptors on the frame and with the motor, pump, driven sheave and housing shown in phantom and the first and second to show the method of installing the belt on the driving and driven sheaves.

Referring now to FIG. 7, motor adapter 14, with motor 16 attached, is shown partially placed within frame 12. Motor adapter 14 is comprised of a top 94, first end 96, second end 98 and sides 100. Motor 16 is secured to motor adapter 14, by bolting the bottom of motor 16 to top 94. Extending horizontally from top 94 and beyond second end 98 is curved flange 58.

Housing 22, is comprised of a first side 104, a second side 106, a top 108 and a face 110. First side 104 is equipped with a handle 114 and a handle seat 116. Second side 106 contains a latch seat 118. Valves 120 may be stored on top 94, and are for the connection of tubes or pipes necessary for the use of apparatus 10.

In assembling, pump 20 is placed within pump adapter 18 with driven sheave 124 facing first side 24 of frame 12. Thereafter, pump 20, attached to pump adapter 18 is locked within frame 12. This step is accomplished by aligning first end 80 of pump adapter 18 with first end 28 of frame 12. Pump adapter 18 is lowered into frame 12 with fingers 90 engaging notches 42. Force is then exerted on second end 82 of pump adapter 18 to engage bar 40 into cutout portion 88.

Next, motor 16 is positioned within motor adapter 14 with driving sheave 126 facing first side 24 of frame 12. Motor adapter 14 is then partially lowered into frame 12 with first end 96 of motor adapter 14 touching second end 82 of pump adapter 18. At this point, driven sheave 124 and driving sheave 126 are being maintained in "operational all alignment." Operational alignment means that the sheaves are co-planar and spaced apart a sufficient distance so that a belt 128 circling sheaves 124 and 126 would be tight enough to transfer rotational motion of driving sheave 126 to driven sheave 126. Motor adapter 14 is rotated toward pump adapter 18 to allow a user to place belt 128 around sheaves 124 and 126. Second end 98 of motor adapter 14 is then lowered in frame 12, which in turn causes belt 128 to experience the proper amount of tension. Swing lock 52 is then swung over curved flange 58, locking motor adapter 14 into frame 12.

When both adapters are within frame 12, first end 80 of pump adapter 18 abuts first end 28 of frame 12, and second end 98 of motor adapter 14 abuts second end 30 of frame 12. Moreover, the sides of both adapters are flush with the sides of frame 12. Consequently, there is no "rattling" of motor 16 or pump 20 while locked in frame 12.

Housing 22 is then lowered into position. When in position, handle seat 116 will matingly engage the vertical portion of bar 40, while a portion of face 110 and second side 106 will rest on housing member 46. Thereafter, housing latch 50 is secured to latch seat 118. When in place, housing 22 covers sheaves 124 and 126 and belt 128, thereby reducing the risk of serious injury.

Using modular motors and pumps, as described by the present invention increases the applicability and efficiency of power sprayers. The flexibility provided by the adapters enables one, for example, to choose a motor with a desired amount of power and a particular pump that can handle the particular fluid to be sprayed. Consequently, by using the frame and adapters, the user can customize the apparatus in order to complete a given task.

It will be apparent to those skilled in the art that many modifications and substitutions can be made to the foregoing preferred embodiment without departing from the spirit and scope of the present invention, which is defined by the appended claims.

What is claimed is:

1. A spraying apparatus comprising:

a frame;

a motor having a driving sheave;

a pump having a driven sheave;

a belt for transferring rotational motion of said driving sheave to rotational motion of said driven sheave;

a first adapter attached to said motor; and a second adapter attached to said pump, said second adapter having means for engaging said frame when said second adapter is positioned in said frame, said frame formed to receive and hold said first and said second adapters so that said driving and said driven sheaves are maintained in operational alignment.

2. The apparatus as recited in claim 1, wherein said frame further comprises first means for locking said first adapter into position on said frame.

3. The apparatus as recited in claim 1, wherein said frame further comprises second means for locking said second adapter into position on said frame.

4. The apparatus as recited in claim 1, wherein said frame further comprises:

first means for locking said first adapter into position on said frame; and second means for locking said second adapter into position on said frame.

5. The apparatus as recited in claim 1, further comprising:

an axle carried by said frame, said axle having two ends; and wheels on each end of said axle.

6. The apparatus as recited in claim 1, further comprising means for covering said driving and said driven sheaves.

7. The apparatus as recited in claim 1, further comprising:

means for covering said driving and said driven sheaves; and means for latching said covering means to said frame.

8. The apparatus as recited in claim 1, wherein said frame has cut-out portions and said engaging means further comprises at least one finger that engages said cut-out portions when said second adapter is positioned on said frame.

9. A spraying apparatus comprising:

a frame;

a motor having a driving sheave;

a pump having a driven sheave;

a belt for transferring rotational motion of said driving sheave to rotational motion of said driven sheave;

a first adapter attached to said motor;

a second adapter attached to said pump, said frame formed to receive and hold said first and said second adapters in spatial relationship so that said driving and said driven sheaves are maintained in operational alignment;

a swing lock positioned on said frame to engage said first adapter so that as said swing lock is swung, it locks said first adapter to said frame; and second means for locking said second adapter onto said frame.

10. The apparatus as recited in claim 9, further comprising:

an axle carried by said frame, said axle having two ends; and wheels on each end of said axle.

11. The apparatus as recited in claim 9, wherein said second adapter has a cutout portion, and said second locking means is bar means positioned on said frame for engaging said cutout portion of said second adapter and, as said first adapter is positioned on said frame, said bar means enters said cutout portion to lock said second adapter to said frame.

12. The apparatus as recited in claim 9, further comprising means for covering said driving and said driven sheaves.

13. The apparatus as recited in claim 9, further comprising:

means for covering said driving and said driven sheaves; and means for latching said covering means to said frame.

14. The apparatus as recited in claim 9, wherein said frame is dimensioned to receive said first and said second adapters in adjacent relationship, wherein said first and second adapters can be rotated between a first position wherein said belt is tight and operational on said driving and said driven sheaves and a second position wherein said belt is loosened and removable from said driving and said driven sheaves.

15. A spraying apparatus comprising:

a frame having bar means;

a motor having a driving sheave;

a pump having a driven sheave;

a belt for transferring rotational motion of said driving sheave to rotational motion of said driven sheave;

means carried by said frame for covering said driving and said driven sheaves;

a first adapter attached to said motor;

a second adapter attached to said pump, said second adapter having a cutout portion for engaging said bar means of said frame as said first adapter is positioned on said frame, said bar means entering said cutout portion to lock said second adapter to said frame, said frame formed to receive and hold said first and said second adapters in spatial relationship so that said driving and said driven sheaves are maintained in operational alignment;

an axle carried by said frame, said axle having two ends; and wheels on each end of said axle.

16. The apparatus as recited in claim 15, further comprising first means for locking said first adapter to said frame.

17. The apparatus as recited in claim 15, further comprising means for latching said cover to said frame.

18. The apparatus as recited in claim 15, wherein said frame is dimensioned to receive said first and said second adapters in adjacent relationship, wherein said first and second adapters can be rotated between a first position wherein said belt is tight and operational on said driving and said driven sheaves and a second position wherein said belt is loosened and removable from said driving and said driven sheaves.

19. The apparatus as recited in claim 15, further comprising a swing lock positioned on said frame to engage said first adapter so that as said swing lock is swung, it locks said first adapter to said frame.

20. The apparatus as recited in claim 15, further comprising a handle on said covering means, said handle attachable to said bar means of said frame.

* * * * *